US008528845B2

(12) United States Patent
Ragnarsson

(10) Patent No.: US 8,528,845 B2
(45) Date of Patent: Sep. 10, 2013

(54) FLEXIBLE CHIPPER CHUTE HAVING TWO CHIP DISCHARGE CONFIGURATIONS

(76) Inventor: Anders Ragnarsson, Chester, NH (US)

( * ) Notice: Subject to any disclaimer, the term of this patent is extended or adjusted under 35 U.S.C. 154(b) by 381 days.

(21) Appl. No.: 13/102,515

(22) Filed: May 6, 2011

(65) Prior Publication Data

US 2011/0272510 A1 Nov. 10, 2011

Related U.S. Application Data

(60) Provisional application No. 61/332,425, filed on May 7, 2010.

(51) Int. Cl.
*B02C 18/22* (2006.01)

(52) U.S. Cl.
USPC ..... 241/101.76; 241/101.73; 241/101.74; 241/101.75; 241/101.77; 241/101.78; 241/262; 241/263; 241/264; 241/266

(58) Field of Classification Search
USPC ..... 241/101.73–101.78, 262–266
See application file for complete search history.

(56) References Cited

U.S. PATENT DOCUMENTS 3,874,602 A * 4/1975 Ciriegio ..... 241/186.4
4,395,867 A * 8/1983 Cooper et al. ..... 56/327.1
4,442,877 A * 4/1984 Uitermarkt ..... 144/172
5,390,862 A * 2/1995 Eglin ..... 241/29
5,979,151 A * 11/1999 Sanders et al. ..... 56/60
6,357,684 B1 * 3/2002 Morey ..... 241/301
7,063,614 B2 * 6/2006 Vogelgesang et al. ..... 460/114
7,083,129 B2 * 8/2006 Beam, III ..... 241/37.5
2007/0267526 A1 * 11/2007 Uhrich et al. ..... 241/30
2009/0113866 A1 * 5/2009 Haffert ..... 56/13.3

* cited by examiner

*Primary Examiner* — Dana Ross
*Assistant Examiner* — Onekki Jolly
(74) *Attorney, Agent, or Firm* — Davis & Bujold, PLLC

(57) ABSTRACT

A chip discharge chute having a flexible chute main section having an upstream end connectable from a chipping machine output, a main section elevation mechanism connected to the downstream end of the chute main section for controlling a height of the downstream end of the flexible main section with respect to a chip receiving area, and a chute deflector section pivotably connected to the downstream end of the flexible main section for receiving chips from the downstream end of the chute main section and a downstream end with a downwardly directed ejection opening for discharging chips into the chip receiving area. The chute deflector section is rotated out of alignment with the chute main section so that the chip discharge path includes only the chute main section when the chips are to be discharged along the horizontal trajectory and is rotated into alignment with the chute main section so that the chip discharge path includes both the chute main section and the chute deflector section when the chips are to be discharged along the generally vertically downward trajectory.

10 Claims, 7 Drawing Sheets

FLEXIBLE CHIPPER CHUTE HAVING TWO CHIP DISCHARGE CONFIGURATIONS

CROSS REFERENCE TO RELATED APPLICATIONS

This application claims benefit of U.S. Provisional Patent Appln. No. 61/332,425 filed May 7, 2010 by Anders Ragnarsson for a FLEXIBLE CHIPPER CHUTE.

FIELD OF THE INVENTION

The present invention relates to a chip discharge chute for guiding chips discharged from a chipping machine into a receptacle or receiving area and, in particular, to a flexible chipper chute that is adjustable to guide chips discharged from a chipping machine along a generally horizontal trajectory, for example, into an end loading truck or a trailer, or along a generally vertically downward trajectory into a top loading truck or a trailer.

BACKGROUND OF THE INVENTION

Chipping machines are commonly used for reducing vegetation, ranging from branches and twigs to logs and tree trunks, into "chips". That is, fragments of a relatively uniform range of relatively smaller sizes for subsequent disposal or for various uses, such as the manufacture of various wood and vegetation derivative products or the fueling power plants or heating systems.

A typical chipping machine generally comprises a chipping drum rotating at a relatively high rotational speed within a chipping chamber for receiving various forms and sizes of vegetation via an input chute or conveyer. The chipping drum and the interior of the chipping chamber are typically provided with some form of chipping teeth or strikers and cooperating anvils which, in combination with the chipping drum, reduce the inputted vegetation to chips of a relative uniform range of sizes. The chips are then expelled through an output chute and into a receiving area or container, such as a storage compartment of a truck or a trailer.

The dimensions of the elements of a chipping machine will vary depending upon the sizes of the vegetation to be chipped and may range, for example, from backyard sized units, for small landscaping projects, or larger truck or trailer mounted units for substantial clearing and cleanup, such as may be required in major landscaping projects and building site development, to very large units such as may be used in logging or wood product harvesting operations or in large land clearance operations.

In general, however, a chipping machine of a given size will be capable of dealing efficiently with an economically acceptable range of vegetation sizes and types, so that the typical range of vegetation size and type in a given region of use generally does not present a problem with regard to economically sufficient utilization of the machine.

A recurring problem with chipping machines, however, is that a given machine may be required to discharge chips into a variety of different receptacles along a corresponding variety of different trajectories. In one instance, for example, a chipping machine may be required to deposit the chips into a receptacle or receiving area, such as through a rear end of a loading truck or a trailer, wherein the chips must be propelled into the truck or the trailer along a generally horizontal trajectory. In another instance, the machine may be required to discharge the chips into a receptacle or receiving area, such as through the top opening of a top loading truck or trailer, wherein the chips must be propelled along a generally vertically downward trajectory into the receptacle or receiving area.

While a given chipping machine may be adapted to horizontal or downward discharge trajectories, such adaptations have typically required mechanical modification of the chipping machine discharge chute by, for example, the replacement of one type of discharge chute with another or at least the replacement of a significant part of the discharge chute by a section having a different mechanical design specific to the desired chip discharge trajectory. Such modifications of a chipping machine, to adapt the machine to different chip discharge trajectories, is generally costly in both time and effort.

The problem is further compounded in that the discharge chute of a chipping machine, and in particular the discharge chute of a larger capacity chipping machine, is required to be of sufficient strength and durability to withstand the repeated and long term impact of the chips and other objects, such as stones and fragments of non-vegetable matter, etc., that may be of significant size and weight and that are typically traveling at significant speeds.

This, in turn, means that the parts that must be exchanged or added in order to modify the discharge trajectory of a chipping machine typically are of significant size and weight, thereby increasing the time and cost required to adapt a given machine to different discharge trajectories, as well as presenting a risk of serious injury to the personnel performing such adaptation(s).

The present invention provides a solution to these and related problems associated with the prior art devices.

SUMMARY OF THE INVENTION

The present invention is directed to a chip discharge chute which provides a chip discharge path for a chipper wherein the chip discharge chute is adjustable to eject chips into a chip receiving area in a selectable one of a horizontal trajectory and a generally vertically downward trajectory.

The chip discharge chute of the present invention includes a chute main section having an upstream end connectable to a chipping machine output, a downstream end connected to a chute main section elevation mechanism for controlling a height of the downstream end of the flexible main section with respect to the chip receiving area, and a chute deflector section pivotably connected to the downstream end of the flexible main section and having an upstream input for receiving chips from the downstream end of the chute main section and a downstream end with a downwardly directed ejection opening for discharging chips into the chip receiving area.

When the chips are to be discharged along the horizontal trajectory, the chute deflector section is rotated out of alignment with the chute main section so that the chip discharge path includes only the chute main section and, when the chips are to be discharged along a generally vertically downward trajectory, the chute deflector section is rotated into alignment with the chute main section so that the chip discharge path includes both the chute main section and the chute deflector section.

According to the present invention, the chute main section includes an upstream connector section connectable from a chipper chip output for receiving chips from the chipper, a downstream connector section for discharging the chips from the chute main section and supported by the chute mains section elevation mechanism for controlling the height of the downstream end of the main section with respect to the chip receiving area, and a flexible section connected between the upstream connector section and the downstream connector section, the flexible section having a generally straight configuration when the downstream connector section is elevated to a horizontal trajectory elevation and having a generally curved configuration when the downstream connector section is elevated to a generally vertically downward trajectory orientation.

The chute main section includes a flexible top plate extending a length of and forming a top wall of the upstream connector section, the flexible section and the downstream connection, the upstream connector section includes a rigid assembly forming a bottom and side walls of the upstream connector section, and the downstream connector section includes a rigid assembly forming a bottom and side walls of the downstream connector section. The flexible section includes a plurality of axially contiguous and partially overlapping flex-plates with each flex-plate forming a bottom and the side walls of the flexible section. The flex-plates form a continuous, enclosed section of the chute which has a generally straight or planar configuration, when the downstream connector section is in a raised position, to facilitate a generally vertically downward trajectory of the chips from the chute, and, the chute has a generally curved configuration, when the downstream connector section is in a lowered position, to facilitate a generally horizontal trajectory of the chips from the chute.

The bottom wall of the downstream connector section is curved upwardly and wherein the downstream connector section is mounted to the chute main section elevation mechanism by an elevation mechanism bracket connected to the downstream connector section.

The chute deflector section includes a deflector flip section pivotably mounted to the downstream end of the downstream connector section and rotatable into and out of alignment with the downstream connector section and a deflector hood mounted to a downstream end of the deflector flip section for engaging with and deflecting the chips along the generally vertically downward trajectory.

The deflector flip section includes a top wall and side walls and a bottom wall having an arch shaped cut-away portion toward the downstream end of the deflector flip section bottom wall to provide a downwardly oriented chip discharge or exit path, and the upstream end of the deflector flip section is rotatably mounted to the downstream end of the downstream connector section.

The deflector flip section further includes a flip rotation mechanism, connected between the downstream connector section support bracket and the deflector flip section, for rotating the deflector flip section into and out of alignment with the downstream connector section. In addition, the upstream end of the deflector hood is rotatably mounted to and mates with the downstream end of the deflector flip section and includes a deflector hood rotation mechanism connected between the deflector hood and the deflector flip section for adjustably selecting an angle between the deflector hood and the deflector flip section to adjust the generally vertically downward trajectory of chips ejected from the chip discharge chute. For this purpose, the downstream section of an upper wall of the deflector hood is curved downward to deflect the chips in a downward direction along the generally vertically downward trajectory.

BRIEF DESCRIPTION OF THE DRAWINGS

The invention will now be described, by way of example, with reference to the accompanying drawings in which.

DETAILED DESCRIPTION OF THE INVENTION

Figure 1A:
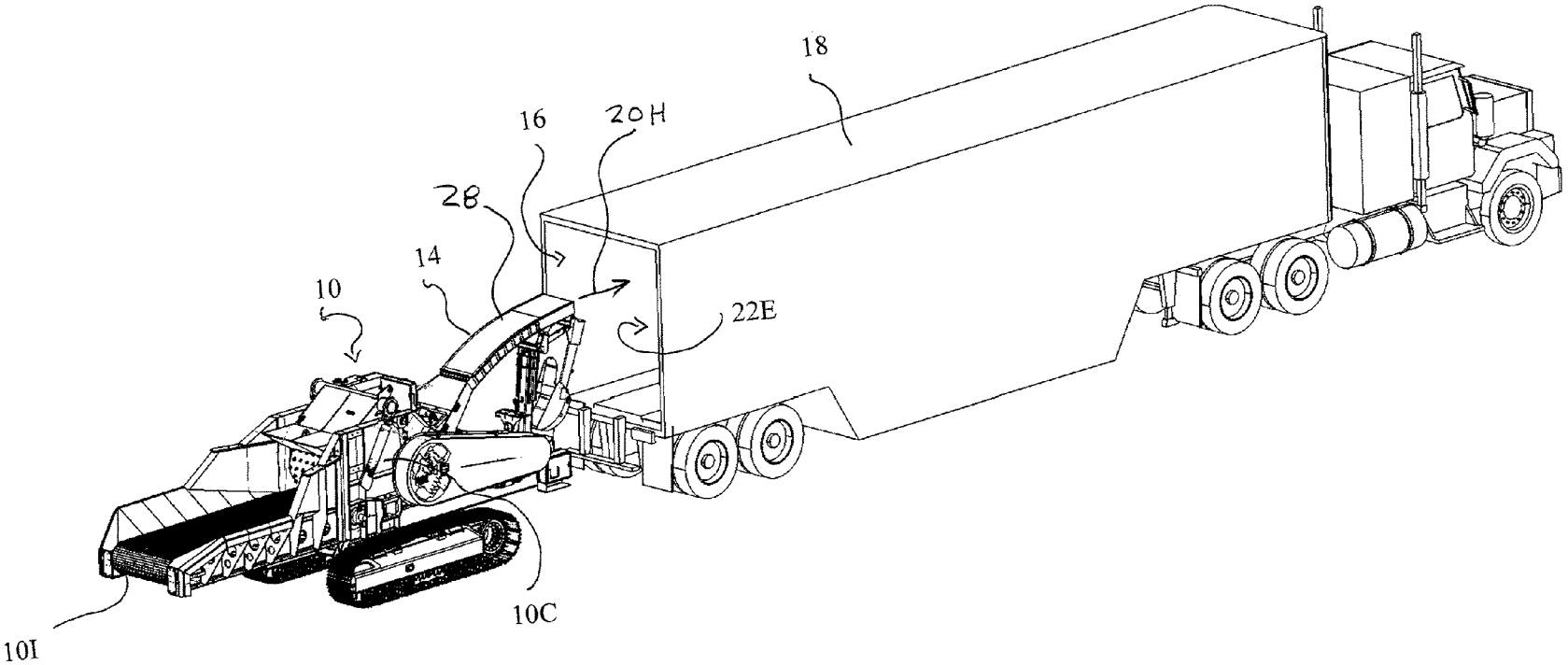
FIGS. 1A and 1B are respectively isometric and side elevational views of a chipper, according to the present invention, with the chip chute configured for chip ejection along a generally horizontal trajectory.

As illustrated in FIGS. 1A, 1B, 2A and 2B, an exemplary chipping machine 10 of the present invention includes an internal chipping chamber 10C which receives various types, forms, shapes and/or sizes of vegetation, via an input chute or conveyer 101. As is conventional in the art, a rotating chipping drum (not shown) supports a plurality of spaced apart chipping teeth, strikers or other reducing components (not shown) which interact with at least one anvil (also not shown) supported by the inwardly facing surface within the chipping chamber 10C. The rotating chipping teeth or strikers, of the chipping drum, and the anvil(s), located on the interior surfaces of the chipping chamber 10C, cooperate with one another to reduce the input vegetation into chips of relatively uniform range of sizes. The chips are subsequently expelled from the chipping chamber 10C, along a chute output path 12, and conveyed along an output chute 14 to a receiving area 16 of a mobile receptacle 18. The chute output path 12 comprises a chute input end 121 connected to an outlet port (not shown in detail) of the chipper chamber 10C and an output end 12P from which chips are ejected from the output chute 14 into the receiving area 16.

Figure 1B:
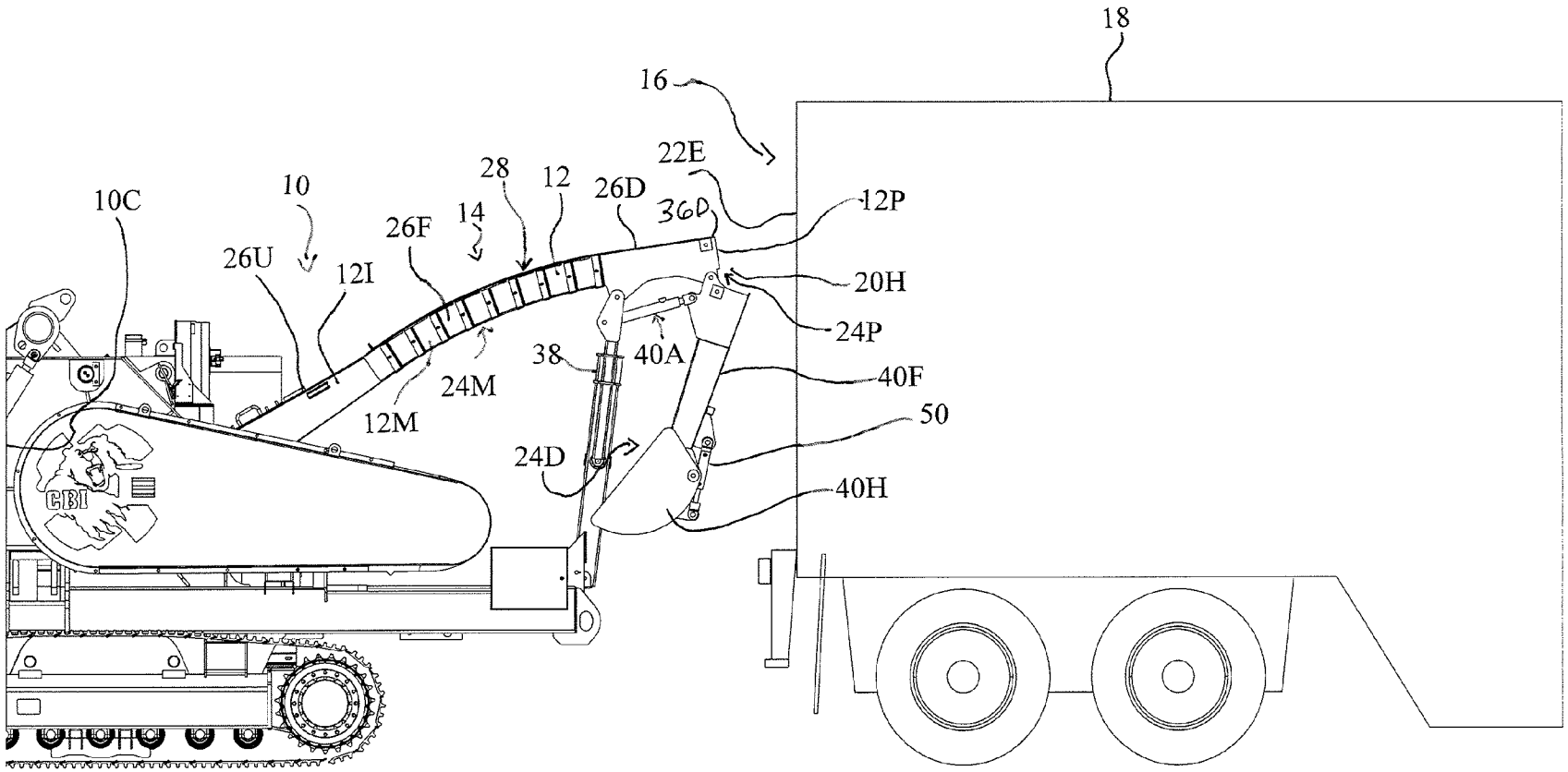
Figure 2A:
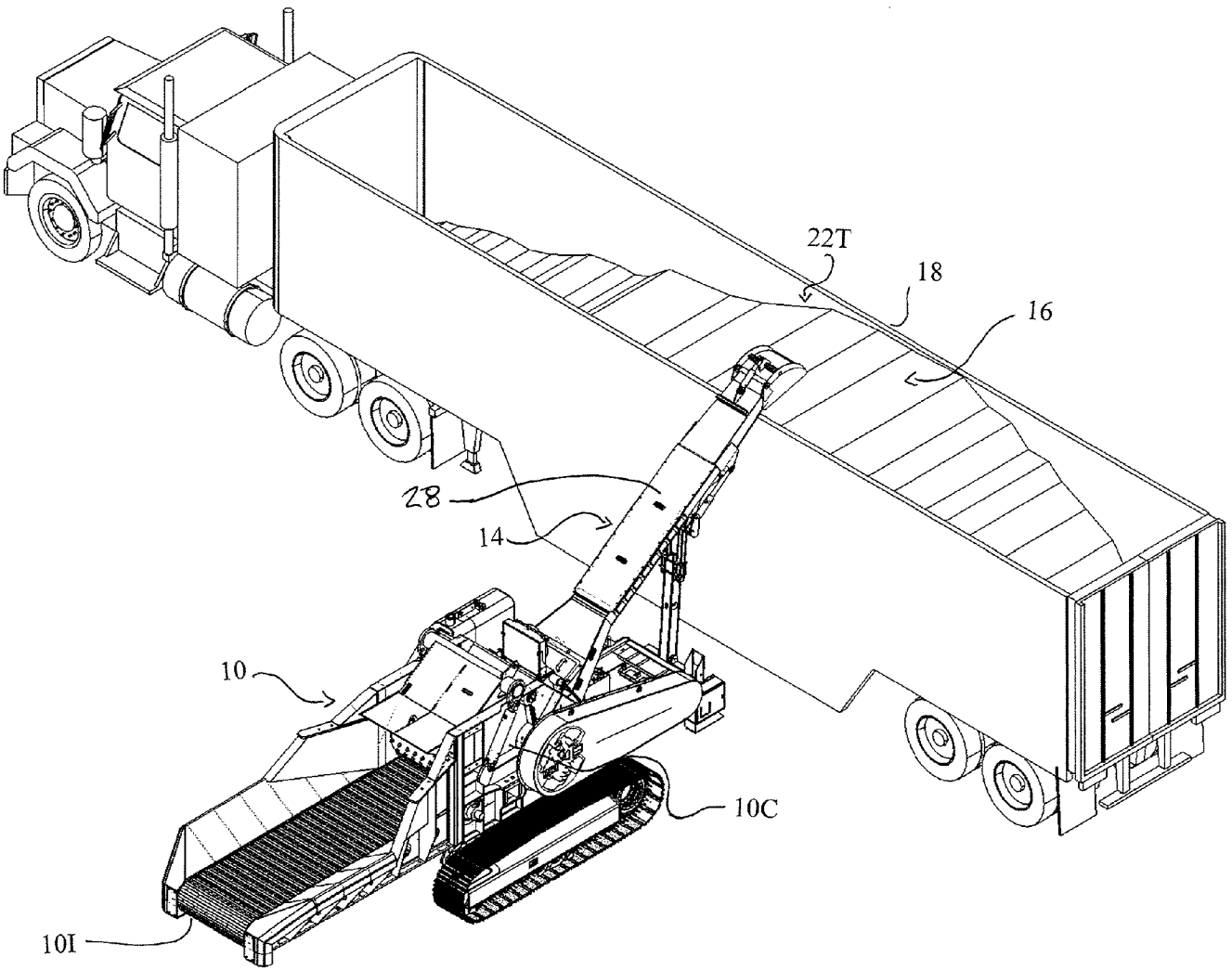
FIGS. 2A and 2B are respectively isometric and side elevational views of the chipper, according to the present invention, with the chip chute configured for chip ejection along a generally vertically downward trajectory.
Figure 2B:
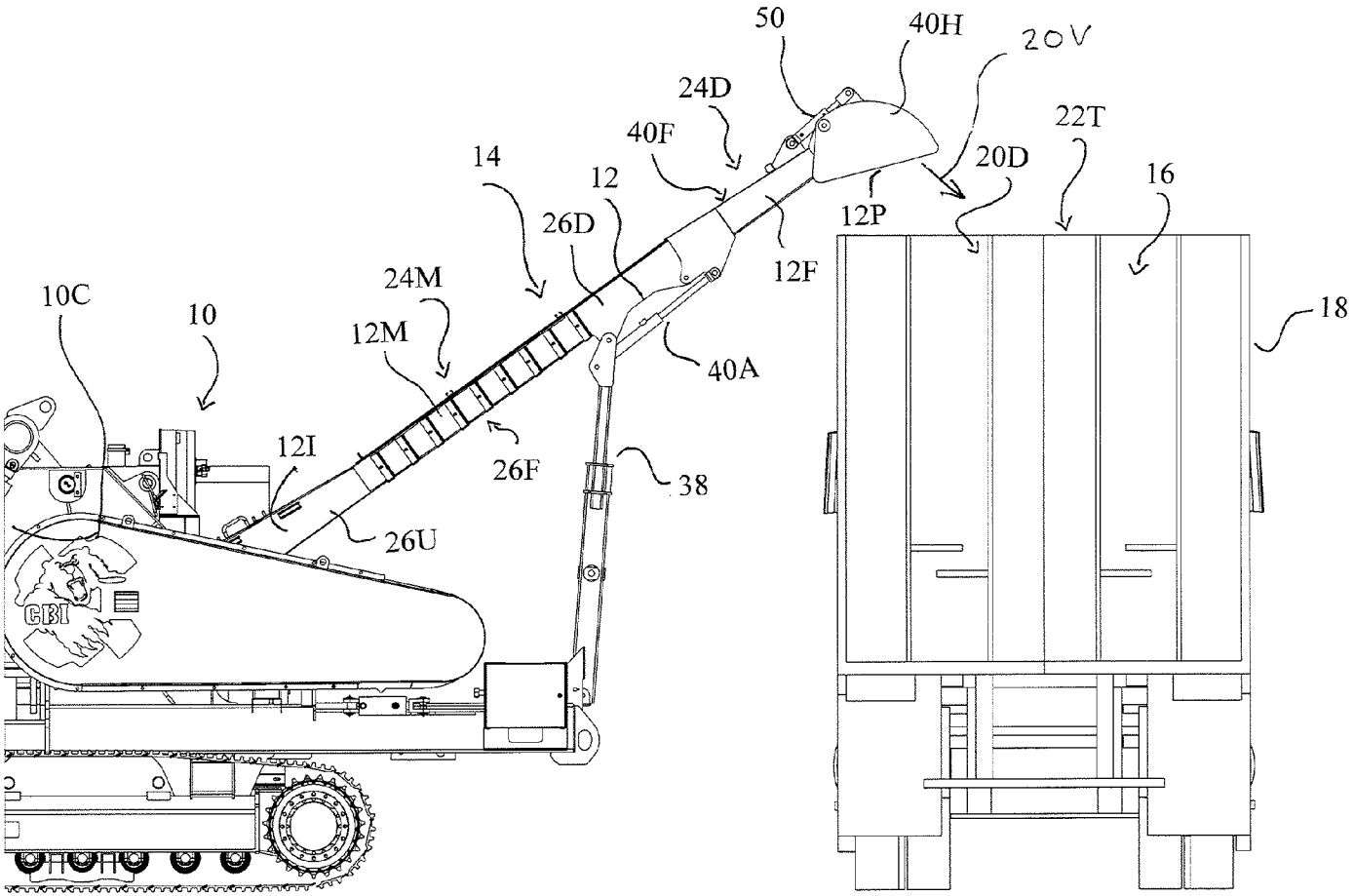

As briefly discussed previously, the chipping machine 10 may be required to eject the chips into a receiving area 16 along either a generally horizontal trajectory, as generally illustrated in FIGS. 1A and 1B, or along a generally vertically downward trajectory, as illustrated in FIGS. 2A and 2B. For this purpose, and as will be described in detail below, the output chute 14 of the present invention permits the chipping machine 10 to be quickly and easily adapted to eject chips either along the generally horizontal trajectory 20H, as illustrated in FIGS. 1A and 1B, or the generally vertically downward trajectory 20V, as illustrated in FIGS. 2A and 2B.

Referring now to FIGS. 1A and 1B, those Figures respectively show a diagrammatic isometric view and a side view of an exemplary chipping machine 10 with the output chute 14 adjusted to discharge chips along the output path 12 which terminates in a horizontal trajectory 20H (see FIG. 1A) into the receiving area 16 of the receptacle 18. In this example, the receptacle 18 comprises a trailer of a tractor/trailer combination, and the horizontal trajectory 20H flows into the receptacle 18 through an end opening 22E provided therein.

FIGS. 2A and 2B, in turn, respectively show a diagrammatic isometric view and a side view of the chipping machine 10 with the output chute 14 adjusted to discharge chips along the generally vertically downward trajectory 20D (see FIG. 2B) into the receiving area 16 of the receptacle 18. In this example, the receptacle 16 again comprises a trailer of a tractor/trailer combination and the generally vertically downward trajectory 20D flows downward into the receptacle 18 through a top opening 22T provided therein. The output chute 14 is configured to be either substantially straight (see FIGS. 2A and 2B), or only slightly curved (see FIGS. 1A and 1B), so that the wood chips, as they flow along the output chute 14; maintain a maximum velocity, when discharge from the output end 12P, so that the wood chips can reach the far end of the receptacle 18.

As shown generally in FIGS. 1A, 1B, 2A and 2B, the output chute 14 of the present invention includes a main section 24M which comprises a lower portion of the output chute 14 and forms a main section 12M of the output path 12 for the chips. A deflector section 24D comprises an upper portion of the output chute 14 and forms a flip section 12F of the output path 12 for chips.

When the output chute 14 is arranged to discharge the chips along the horizontal trajectory 20H, as illustrated in FIG. 1B, the deflector section 24D is rotated to a stowed first orientation or position so that the deflector section 24D does not form part of the output path 12, and the shortened output path 12 thus comprises only the main section 12M of the output path 12, which is formed by the main section 24M of the output chute 14. As indicated, when the output chute 14 is in the configuration for the horizontal trajectory 20H, as illustrated in FIG. 1B, the main section 24M of the output chute 14 will typically be slightly curved so that flexible section output 24P, and thus the output from the output chute 14 is directed into the receiving area 16 which is, in this case, the end opening 22E of the receptacle 18 along the horizontal trajectory 20H, i.e., the output path 12 includes only the main section 12M.

When the output chute 14 is to discharge the chips along the downwardly oriented generally vertically downward trajectory 20D, as illustrated in FIG. 2B, the deflector section 24D is rotated into an operative second orientation or position so that the deflector section 24D now forms a part of the output path 12. That is, the output path 12 now includes both the main section 12M as well as the flip section 12F, and the terminal end of the output path 12 is deflected vertically downward, along vertically downward oriented trajectory 20D, by the deflector section 24D and into the receiving area 16 which, in this instance, comprises the top opening 22T of the receptacle 18. As indicated, when the output chute 14 is in the downward trajectory configuration, as illustrated in FIG. 2B, the main section 24M of the output chute 14 will be generally straight or planar so as to permit raising the outlet of the deflector section 24D a level above the top opening 22T of the receptacle 18 so that the chips are thus directed downward through the top opening 22T along the generally vertically downward trajectory 20D.

Figure 3B:
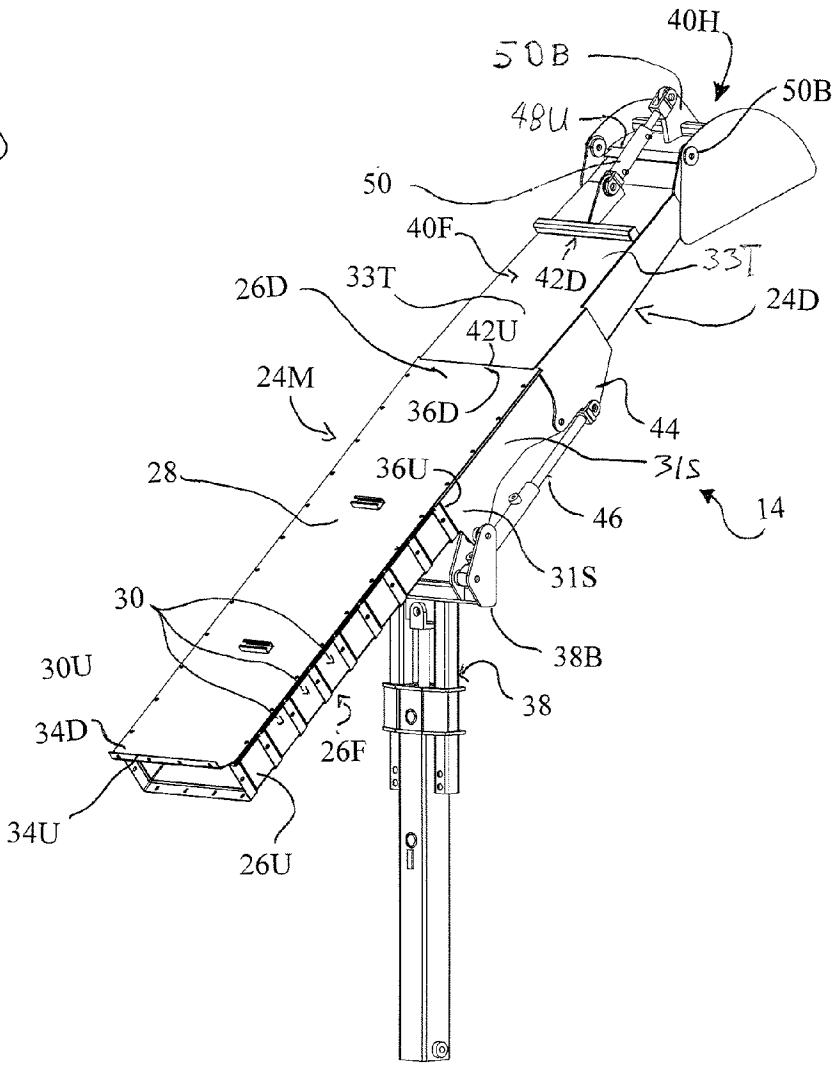
FIGS. 3A and 3B are respectively bottom and top isometric views of the chip chute, according to the present invention.
Figure 3A:
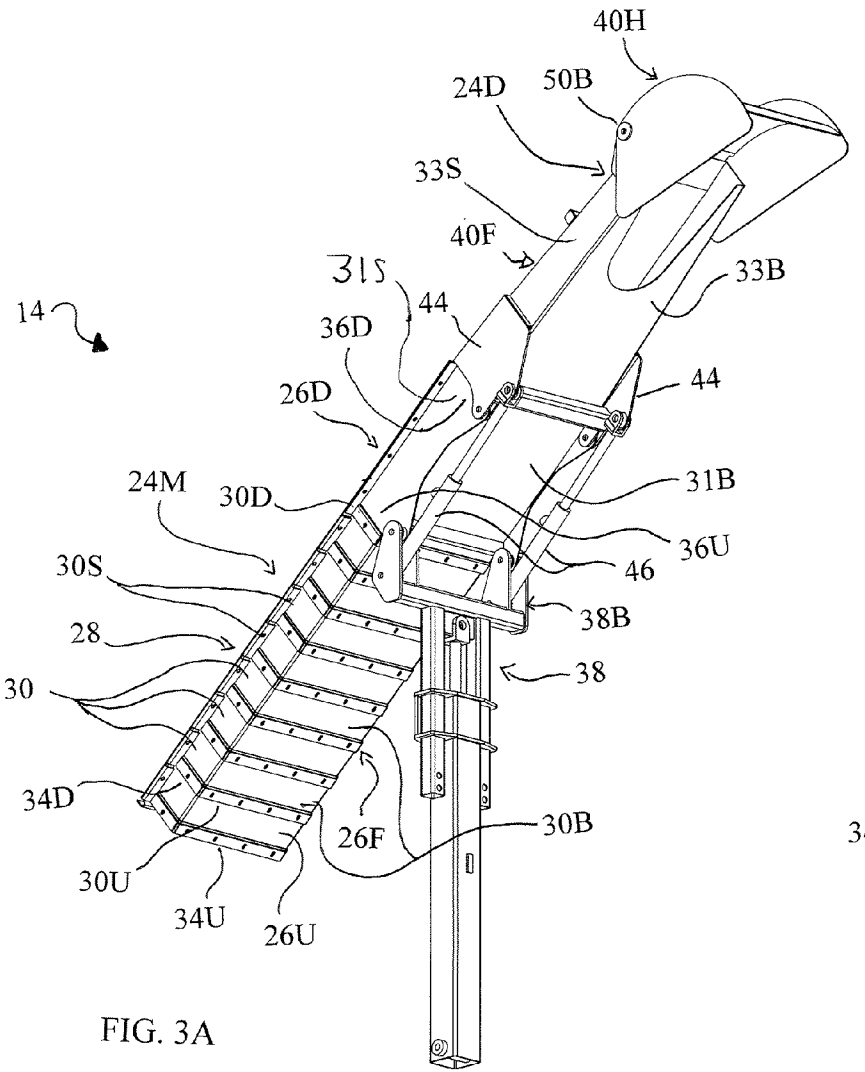

Referring to FIGS. 3A and 3B, therein are respectively shown diagrammatic isometric front and rear views of the chipper machine output chute 14 of the present invention with the deflector section 24D rotated so that the deflector section 24D is in alignment with the main section 24M and thus the flip section 12F forms a portion of the output path 12. As illustrated therein, the main section 24M of the output chute 14 includes an upstream connector section 26U which is connected to an outlet port (not shown) of the chipping chamber 10C, a downstream connector section 26D which is connectable with the deflector section 24D, and a flexible section 26F which couples the upstream connector section 26U with the downstream connector section 26D. The upstream connector section 26U, the downstream connector section 26D and the flexible section 26F thereby together comprise the main section 24M of the chute output path 12.

Figure 3C:
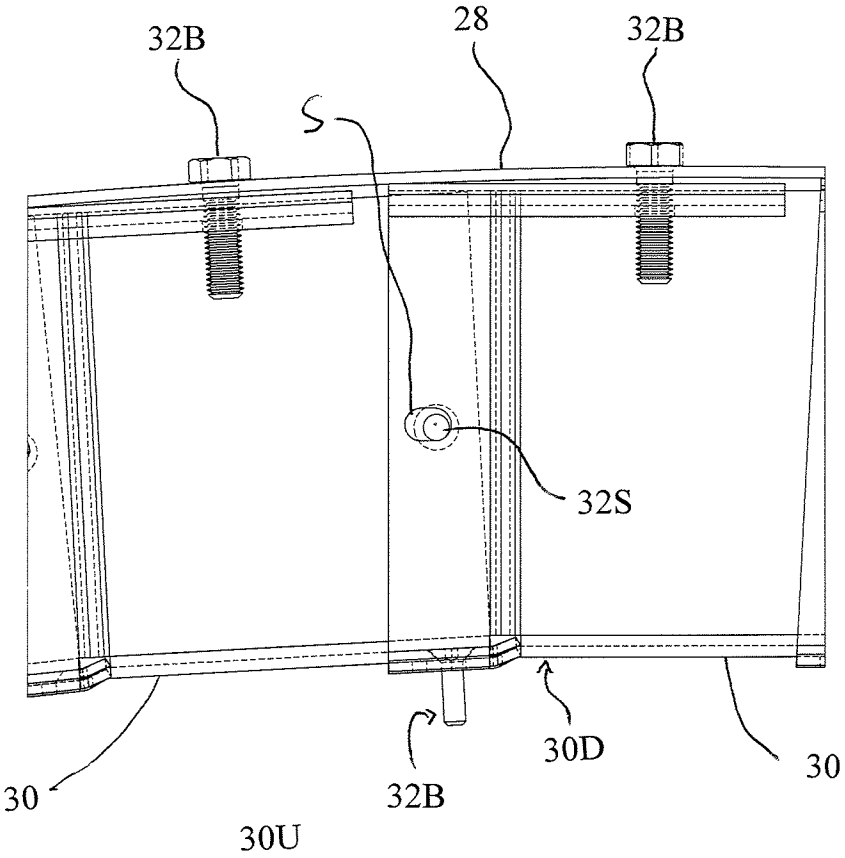
FIG. 3C is a diagrammatic section side view of a section of a chip chute.
Figure 3D:
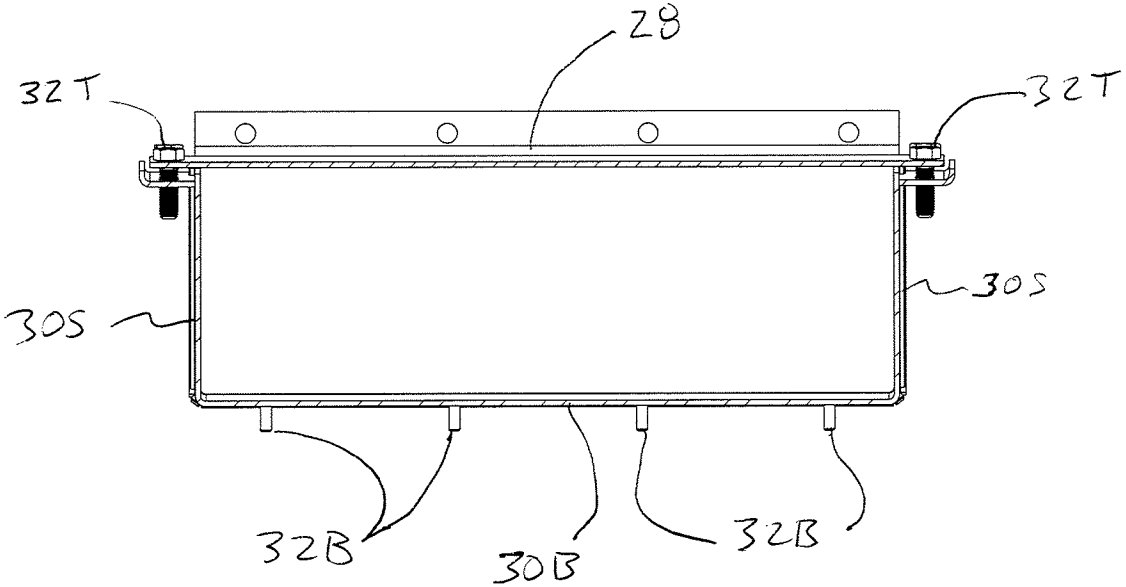
FIG. 3D is a diagrammatic end elevational view of the section of a the chute pf FIG. 3D.

As illustrated, the upstream connection section 26U, the flexible section 26F and the downstream connector section 26D generally include a single, unitary bendable top plate 28 (see FIGS. 1A and 2A, for example) which extends along the length of the main section 24M and forms the upper surface or wall of the portion of the output path 12 located within the main section 24M. It is to be appreciated that the bendable top plate 28 generally has a planar configuration, as shown in FIGS. 3A and 3B but can be bent into a curved configuration, as shown in FIGS. 1A and 1B, as described below in further detail. A pair of opposed side walls 30S and a bottom wall 30B of the flexible section 26F, in turn, comprise a plurality of axially contiguous flex-plates 30. Each one of the flex-plates 30 has a generally U-shaped cross sectional profile (see FIG. 3D) formed by the two opposed vertical side walls 30S and the bottom wall 30B with lateral flanges of the upper ends of the side walls 30S being secured to the top plate 28 by bolts 32T, for example. According to one embodiment, a portion of the flexible section 26F, as illustrated in FIG. 3C, the upstream end 30U of each flex-plate 30, that is, the leading edges of the side walls 30S and the bottom wall 30B of each flex-plate 30, in the direction in which the chips flow through the flexible section 24F, are flared or tapered outward so as closely partially overlap with the trailing end of the upstream flex-plate 30 but permit relative sliding or telescoping movement therebetween. That is, both of the opposed side walls 30S of the leading end of the upstream flex-plate 30 has a slot S while a respective bolt 32S extends through each slot and connects the leading end of the upstream flex-plate 30 with the trailing end of the adjacent downstream flex-plate 30 in an overlapped manner (see FIG. 3C). In addition, the bottom wall 30B of the leading end of the upstream flex-plate 30 has four (4) slots while a respective bolt 32B extends through each corresponding slot and connects the leading end of the upstream flex-plate 30 with the trailing end of the adjacent downstream flex-plate 30 in an overlapped manner. Such connection of the flex plates 30 with the top plate 28 allows the chute 14 to be quickly bent into the desired curved configuration for horizontal trajectory 20H.

In this regard, it will be noted that the construction of the top plate 28, as a single bendable plate, which generally extends the length of the main section 24M of the output chute 14, provides a bendable "backbone" for the assembly, which comprises the upstream connector section 26U, the flexible section 26F and the downstream connector section 26D, and maintains the mechanical relationship between the flex-plates 30 of the flexible section 26F and the mechanical relationship between the flexible section 26F and the upstream and the downstream connector sections 26U and 26D as the flexible section 26F bends and straightens.

As illustrated, the upstream connector section 26U is generally constructed as a single, rigid assembly comprising the upstream end portion of the top plate 28 and side and bottom walls formed as single, unitary U-shaped piece, as in the case of the flex-plates 30, but with a total axial length that is typically axially greater than the length of each of the flex-plates 30. As illustrated, the upstream end 34U of the upstream connector section 26U is adapted to be structurally fixed to the frame of the chipping machine 10 and, in particular, to the outlet port of chipping chamber 10C, by bolts or some other conventional securing mechanism, while the downstream end 34D of the upstream connection section 30U is constructed in the same manner as the downstream end of each of the flex-plates 30. That is, the downstream end 34D of the upstream connector section 26U is preferably constructed as a flared joint with, for example, the connecting bolts sliding in the corresponding slots so that the first upstream flex-plate 30 of the flexible section 26F can mate with the upstream connector section 30U in the same manner as the flex-plates 30 connect to one another, i.e., in an overlapped manner.

The upstream connector section 26U thereby fixes the location of the upstream end of the main section 24M of the chute 14 and thus of the start of output path 12 with respect to the flow of the chips from the chipping chamber 10C. It will also be noted that the mechanical mounting of the furthermost upstream flex-plate 30 also fixes the starting angular orientation of the main section 24M and the output path 12 with respect to horizontal and vertical planes and thus the possible angular orientations of the horizontal trajectory 20H and the generally vertically downward trajectory 20D for a given curvature of the main section 24M of the chute 14.

On the other hand, the downstream connector section 26D of the main section 24M of chute 14, like the upstream connector section 26U, is constructed as a single, rigid assembly comprising the downstream end portion of top plate 28 and side and bottom walls 31S and 31B of the downstream connector section 26D formed as single U-shaped assembly or piece, but with a total axial length that again is typically greater than the axial length of each one of the flex-plates 30. The upstream end 36U of the downstream connector section 26D is constructed in the same manner as the upstream end of each of the flex-plates 30. That is, the upstream end 36U of the downstream connector section 26D is preferably constructed as a flared joint with, for example, the connecting bolts sliding in the corresponding slots, so that the last upstream flex-plate 30 of the flexible section 26F can mate with the downstream connector section 26D in the same manner as the flex-plates 30 are connected to one another, i.e., in an overlapped manner. The downstream end 36D of the downstream connector 26D, as will be discussed in further detail below, is adapted to mate with the upstream end of deflector section 24D, when the deflector section 24D is in its operative second orientation aligned with the main section 24M of the chute 14, so that the chips may be discharged downward along the generally vertically downward trajectory 20D.

As illustrated in FIGS. 1B, 2B, 3A and 3B, the bottom wall 31B of downstream connector section 26D may be arched upward over the length of the downstream connector section 26D, thereby strengthening this section of the main section 24M, which, as shown and as discussed below, is adjustable and supported by a chute elevation hydraulic cylinder mechanism 38. The chute elevation hydraulic cylinder mechanism 38, typically hydraulic powered in a conventional manner, couples a downstream connector section support bracket 38B, mounted to the lower portion of the downstream connector section 26D, with the frame of the chipping machine 10. When in the horizontal trajectory 20H mode of operation, the chute elevation hydraulic cylinder mechanism 38 is activated into a retracted position (see FIGS. 1A and 1B). This thereby lowers the downstream connector section 26D, with respect to a horizontal plane, and directs the chips which are to be ejected from chute output path 12 along the horizontal trajectory 20H. This curved configuration also facilitates curving the chute 14 around a motor and/or other equipment which may be located adjacent the outlet port for the internal chipping chamber 10C. The main section 24M of the chute 14 assumes an arched configuration between the upstream connector section 26U and the downstream connector section 26D, as shown in FIG. 1B, for example. It will also be noted that the resulting narrowing of the output path 12, in this terminal region of the main section 24M of the output chute 14 due to the slight upward arched shape of the bottom wall 31B and the slight inwardly tapering of the sidewalls 31S in this region, further assists with ejection of the chips from the chute 14 due to the increase in air flow velocity in this narrowed region of the path 12. The arched bottom wall 31B of the downstream connector section 26D also assists with shaping the ejected path of the chips and the air in both the horizontal trajectory 20H as well as the generally vertically downward trajectory 20D configurations by imposing an upward deflection on the air and the chip flow in this region.

Turning now to the deflector section 24D of the output chute 14, as described above, when the operator desires the output chute 14 to discharge the chips along the horizontal trajectory 20H, the deflector section 24D is rotated into the stowed first orientation or position in which it does not form part of the output path 12 (see FIGS. 1A and 1B). Thereby, in this configuration the output path 12 comprises only the main section 12M of the path 12, formed by the main section 24M of the output chute 14, and the chute elevation hydraulic cylinder 38 lowers the downstream connector section 26D into a desired the horizontal discharge position or orientation, as shown in FIGS. 1A and 1B. As a consequence, during operation, the chip flow along a very gradual curved section of the flexible section 26F and are ejected along the generally horizontal trajectory 20H, directly from the downstream end 36D of the downstream connector section 26D, without engaging with the deflector section 24D.

When the output chute 14 is configured in the generally vertically downward trajectory 20D mode of operation, the deflector section 24D is rotated to its operative second orientation in which it forms part of the output path 12 so that output path 12 includes both the main section 12M and the flip section 12F of the output path 12, respectively formed by the main section 24M and the deflector section 24D, and the chute elevation hydraulic cylinder 38 also raises or pivots the downstream connector section 26D, with respect to the main frame of the chipping machine 10, into its second operative position to induce the generally vertically downward trajectory 20D of the discharged chips. As a result, the deflector section 24D then deflects the stream of ejected chips and air downward along the generally vertically downward trajectory 20D.

As illustrated in FIGS. 3A and 3B, as well as in FIGS. 1A, 1B, 2A and 2B, the deflector section 24D of the output chute 14 includes the deflector flip section 40F which is pivotably mounted to the downstream connector section 26D and able to be rotated into and out of the output path 12, i.e., to and fro between the first stowed orientation and the second operative orientation, and a deflector hood 40H which is hingedly connected to the downstream end of the deflector flip section 40F.

The flip section 40F primarily comprises an elongated hollow rectangular duct having a top wall 33T, side walls 33S and a bottom wall 33B generally corresponding in dimensions and proportions of the top plate 28, the side walls 31S and the bottom walls 31B of the downstream connector section 26D so as to allow the flip section 40F to engage in an end-to-end alignment with the downstream end 36D of the downstream connector section 26D. As shown, an arch shaped portion of the bottom wall 33B of the flip section 40F is cut away (see FIG. 3A), toward the downstream end 42D of the flip section 40F, to commence a generally downwardly oriented discharge path from the flip section 40F for the stream of chips and air passing along the output path 12.

In a presently preferred embodiment and as shown in the figures, the upstream end 42U of the deflector flip section 40F is rotatably mounted to the downstream end 36D of the downstream connector section 26D by a flip actuator 40A, typically hydraulic powered in a conventional manner, mounted onto the upstream end of the deflector strip section 40F and interconnecting the deflector flip section 40F with the chute elevation hydraulic cylinder 38. As shown, the flip actuator 40A typically includes a flip mounting panel 44 affixed to each side wall 33S of the flip section 40F at the upstream end 42U of the flip section 40F, which may overlap the sidewalls 31S of the downstream connector section 26D at the downstream end 36D of the downstream connector section 26D. Each of the flip mounting panels 44 is pivotably mounted, by bolts or some other conventional pivot connection (not labeled), to the lower edge of the downstream end 36D of each side wall 31S of the downstream connector section 26D, so that the flip section 40F can rotate into and out of alignment with the downstream connector section 26D by suitably actuation of the flip actuator 40A.

As shown, the flip actuator 40A generally comprises a pair of spaced apart hydraulic cylinders 46 connected between the downstream connector section support bracket 38B and the lower part of the flip mounting panel 44, on each side of the flip section 40F and at a point downstream of the pivot connections between the flip mounting panels 44 and the side walls 31S of the downstream connector section 26D. It will be apparent that the operation of the flip rotation hydraulic cylinder mechanism 46 will rotate the flip section 40F into and out of alignment with the downstream connector section 26D.

Referring finally to the deflector hood 40H, as shown in the FIGS. 1B, 2B, 3A, and 3B, the deflector hood 40H has a generally rectangular cross section with an upstream end 48U of dimensions, proportions and configuration designed to overlap and mate with the downstream end 42D of the flip section 40F, in generally the same manner that the flip section 40F mates with the downstream connector section 26D. In the case of the deflector hood 40H, however, the deflector hood 40H is pivotably mounted to the flip section 40F by pivot connections located on each side wall 33S of the deflector hood 40H and the flip section 40F and at the upper edges of downstream end 42D of the flip section 40F and the upstream end 48U of the deflector hood 40H. As shown, the top wall 33T of the deflector hood 40H is curved downward in the downstream direction of the output path 12, to direct the flow of the chips and air through the chute 14 generally in a downward direction, while the bottom of the deflector hood 40H comprises, in conjunction with the arch shaped cutaway portion of the bottom wall 33B of the flip section 40F, the downwardly oriented discharge path for the stream of chips and air flowing along the output path 12.

Lastly with regard to the deflector hood 40H, a deflector hood hydraulic cylinder mechanism 50 connects an upper part of the downstream end 42D of the flip section 40F with an upwardly extending hood hydraulic cylinder bracket 50B located on the upper part of the deflector hood 40H. The deflector hood hydraulic cylinder mechanism 50 is typically hydraulic powered in a conventional manner. The deflector hood hydraulic cylinder mechanism 50 allows an angle, between the deflector hood 40H and a remainder of the flip section 40F, to be adjusted by pivoting rotation of the deflector hood 40H about the pivot mount of the deflector hood 40H to the flip section 40F, to thereby allow adjustment of the downward angle of the generally vertically downward trajectory 20D, as desired by the operator, so as to control the angle at which the stream of chips are discharged and ejected from the deflector hood 40H into the receiving area 16 of the receptacle 18.

Since certain changes may be made in the above described chip discharge chute for guiding the discharge of chips from a chipping machine into a desired receptacle, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A chip discharge chute providing a chip discharge path for a chipper, the chip discharge chute being adjustable to eject chips into a chip receiving area in a selectable one of a horizontal trajectory and a generally vertically downward trajectory, the chip discharge chute comprising:

a chute main section having an upstream end connectable to a chipping machine output;

a chute main section elevation mechanism connected to a downstream end of the chute main section for controlling a height of the downstream end of the chute main section with respect to the chip receiving area;

a chute deflector section being pivotably connected adjacent the downstream end of the chute main section and having an upstream input for receiving chips from the downstream end of the chute main section and a downstream end with an ejection opening for discharging chips into the chip receiving area;

the chute deflector section being rotated into a stowed first orientation out of alignment with the chute main section, when the chips are to be discharged along the horizontal trajectory, so that the chip discharge path includes only the chute main section; and the chute deflector section being rotated into an operative second orientation in alignment with the chute main section, when the chips are to be discharged along the generally vertically downward trajectory, so that the chip discharge path includes both the chute main section and the chute deflector section.

2. The chip discharge chute of claim 1, wherein the chute main section comprises:

an upstream connector section connectable to the chipping machine chip output for receiving chips from the chipping machine, a downstream connector section for discharging the chips from the chute main section and supported by the chute main section elevation mechanism for controlling the height of the downstream end of the main section with respect to the chip receiving area, and a flexible section connected between the upstream connector section and the downstream connector section, the flexible section having a generally planar configuration when the downstream connector section is elevated to the operative second orientation for inducing the generally vertically downward trajectory on the chips and having a generally curved configuration when the downstream connector section is retracted into the stowed first orientation for inducing the generally horizontal trajectory.

3. The chip discharge chute of claim 2, wherein the chute main section comprises:

a flexible top plate extending a length of and forming a top wall of the upstream connector section, the flexible section and the downstream connection, the upstream connector section includes a rigid assembly forming bottom and side walls of the upstream connector section, the downstream connector section includes a rigid assembly forming bottom and side walls of the downstream connector section, and the flexible section includes a plurality of axially contiguous and partially overlapping flex-plates with each flex-plate forming a portion of bottom and side walls of the flexible section so that the plurality of flex-plates form a continuous, enclosed section of the chip discharge chute capable of having a generally straight configuration when the downstream connector section is elevated to a generally vertically downward trajectory orientation and a generally curved configuration when the downstream connector section is elevated to a horizontal trajectory orientation.

4. The chip discharge chute of claim 2, wherein a bottom wall of the downstream connector section is curved upwardly, and the downstream connector section is mounted to the chute main section elevation mechanism by an elevation mechanism bracket connected to the downstream connector section.

5. The chip discharge chute of claim 2, wherein the chute deflector section comprises:

a deflector flip section pivotably mounted to a downstream end of the downstream connector section and rotatable into and out of alignment with the downstream connector section between the stowed first orientation and the operative second orientation; and a deflector hood mounted to a downstream end of the deflector flip section for deflecting the chips into the generally vertically downward trajectory.

6. The chip discharge chute of claim 5, wherein the deflector flip section includes top and side walls and a bottom wall having an arch shaped cut-away portion adjacent the downstream end of the deflector flip section to provide a downwardly oriented chip discharge path.

7. The chip discharge chute of claim 5, wherein an upstream end of the deflector flip section is rotatably mounted to the downstream end of the downstream connector section, and the deflector flip section further comprises a flip rotation mechanism connected between a downstream connector section support bracket and the deflector flip section for rotating the deflector flip section into and out of alignment with the downstream connector section between the stowed first orientation and the operative second orientation.

8. The chip discharge chute of claim 5, wherein an upstream end of the deflector hood is rotatably mounted to and mates with the downstream end of the deflector flip section, and includes a deflector hood rotation mechanism connected between the deflector hood and the deflector flip section for adjustably selecting an angle of alignment between the deflector hood and the deflector flip section to adjust a discharge angle of the generally vertically downward trajectory of chips discharged from the chip discharge chute.

9. The chip discharge chute of claim 8, wherein a downstream section of an upper wall of the deflector hood is curved downward to deflect the chips in a downward direction along the generally vertically downward trajectory.

10. A chip discharge chute providing a chip discharge path for a chipper, the chip discharge chute being adjustable to eject chips into a chip receiving area in a selectable one of a horizontal trajectory and a generally vertically downward trajectory, the chip discharge chute comprising:

a chute main section having an upstream end connectable to a chipping machine output;

a chute main section elevation mechanism connected to a downstream end of the chute main section for controlling a height of the downstream end of the chute main section with respect to the chip receiving area;

a chute deflector section pivotably connected to the downstream end of the chute main section and having an upstream input for receiving chips from the downstream end of the chute main section and a downstream end with a downwardly directed ejection opening for discharging chips into the chip receiving area, the chute deflector section being rotated out of alignment with the chute main section so that the chip discharge path includes only the chute main section when the chips are to be discharged along the horizontal trajectory; and the chute deflector section being rotated into alignment with the chute main section so that the chip discharge path includes both the chute main section and the chute deflector section when the chips are to be discharged along the generally vertically downward trajectory;

an upstream connector section of the chute main section connectable to the chipping machine chip output for receiving chips from the chipping machine, and including a rigid assembly forming bottom and side walls of the upstream connector section;

a downstream connector section of the chute main section for discharging the chips from the chute main section and supported by the chute main section elevation mechanism for controlling the height of the downstream end of the main section with respect to the chip receiving area, and including a rigid assembly forming bottom and side walls of the upstream connector section;

a flexible section of the chute main section connected between the upstream connector section and the downstream connector section, the flexible section having a generally straight configuration when the downstream connector section is elevated to a generally vertically downward trajectory orientation and having a generally curved configuration when the downstream connector section is elevated to a horizontal trajectory orientation;

a flexible top plate of the chute main section extending a length of and forming a top wall of the upstream connector section, the flexible section and the downstream connection, the flexible section of the chute main section including a plurality of axially contiguous and partially overlapping flex-plates with each flex-plate forming a portion of bottom and side walls of the flexible section so that the plurality of flex-plates form a continuous, enclosed section of the chip discharge chute capable of having a generally straight configuration when the downstream connector section is elevated to a generally vertically downward trajectory orientation and a generally curved configuration when the downstream connector section is elevated to a horizontal trajectory orientation;

a bottom wall of the downstream connector section is curved upwardly;

the downstream connector section is mounted to the chute main section elevation mechanism by an elevation mechanism bracket connected to the downstream connector section;

a deflector flip section of the chute deflector section pivotably mounted to a downstream end of the downstream connector section of the chute main section and rotatable into and out of alignment with the downstream connector section, and the deflector flip section including top and side walls and a bottom wall having an arch shaped cut-away portion adjacent the downstream end of the deflector flip section to provide a downwardly oriented chip exit path;

a deflector hood mounted to a downstream end of the deflector flip section for deflecting the chips into the generally vertically downward trajectory;

a downstream section of an upper wall of the deflector hood being curved downward to deflect the chips in a downward direction along the generally vertically downward trajectory;

a flip rotation mechanism connected between a downstream connector section support bracket and the deflector flip section for rotating the deflector flip section into and out of alignment with the downstream connector section an upstream end of the deflector hood rotatably mounted to and mating with the downstream end of the deflector flip section, a deflector hood rotation mechanism connected between the deflector hood and the deflector flip section for adjustably selecting an angle of alignment between the deflector hood and the deflector flip section to adjust the generally vertically downward trajectory of chips ejected from the chip discharge chute.

* * * * *